US010400964B2

(12) United States Patent
Driscoll

(10) Patent No.: US 10,400,964 B2
(45) Date of Patent: Sep. 3, 2019

(54) METHOD AND APPARATUS FOR RETROFIT MOUNTING AND WIRING SMALL APERTURE RECESSED LIGHTING

(71) Applicant: SIGNIFY HOLDING B.V., Eindhoven (NL)

(72) Inventor: Wayne T. Driscoll, East Kingston, NH (US)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 14/427,912

(22) PCT Filed: Apr. 18, 2014

(86) PCT No.: PCT/IB2014/060823
§ 371 (c)(1),
(2) Date: Mar. 12, 2015

(87) PCT Pub. No.: WO2014/174418
PCT Pub. Date: Oct. 30, 2014

(65) Prior Publication Data

US 2016/0040839 A1 Feb. 11, 2016

Related U.S. Application Data

(60) Provisional application No. 61/815,550, filed on Apr. 24, 2013.

(51) Int. Cl.

| | |
|---|---|
| ***F21S 8/02*** | (2006.01) |
| ***F21V 19/00*** | (2006.01) |
| ***F21V 23/00*** | (2015.01) |
| ***F21V 23/02*** | (2006.01) |
| ***F21V 29/76*** | (2015.01) |

(Continued)

(52) U.S. Cl.
CPC ..... *F21S 8/026* (2013.01); *F21V 19/004* (2013.01); *F21V 23/009* (2013.01); *F21V 23/023* (2013.01); *F21V 29/767* (2015.01); *F21V 15/01* (2013.01); *F21V 17/164* (2013.01); *F21V 23/00* (2013.01); *F21Y 2103/10* (2016.08); *F21Y 2115/10* (2016.08)

(58) Field of Classification Search
CPC ..... F21S 8/026; F21S 8/024; F21V 29/767; F21V 21/04; F21V 23/00; F21V 23/023; F21V 21/14; F21Y 2103/10; F21Y 2115/10
USPC ..... 362/294, 150, 149, 235
See application file for complete search history.

(56) References Cited

U.S. PATENT DOCUMENTS

| | | | |
|---|---|---|---|
| 6,402,350 | B1 | 6/2002 | Ward |
| 2006/0221606 | A1 | 10/2006 | Dowling |

(Continued)

FOREIGN PATENT DOCUMENTS

| | | | |
|---|---|---|---|
| EP | 2543923 | A1 | 1/2012 |
| JP | 1993028819 | A | 2/1993 |
| WO | 2013028011 | A2 | 2/2013 |

*Primary Examiner* — Anh T Mai
*Assistant Examiner* — Jessica M Apenteng
(74) *Attorney, Agent, or Firm* — Meenakshy Chakravorty

(57) ABSTRACT

A retrofit LED lighting fixture for retrofitting alight source in a small recessed area. The retrofit LED lighting fixture has a junction box (200) installable through a luminaire housing (100) to fit within the small recessed area. A light engine module (300) is removably attached within the luminaire housing (100).

8 Claims, 11 Drawing Sheets

(51) Int. Cl.

| | |
|---|---|
| *F21V 15/01* | (2006.01) |
| *F21V 17/16* | (2006.01) |
| *F21Y 103/10* | (2016.01) |
| *F21Y 115/10* | (2016.01) |

(56) References Cited

U.S. PATENT DOCUMENTS

| | | | | |
|---|---|---|---|---|
| 2006/0262521 | A1 | 11/2006 | Piepgras et al. | |
| 2009/0034261 | A1 | 2/2009 | Grove | |
| 2010/0020551 | A1* | 1/2010 | Kay | F21V 21/34 362/365 |
| 2010/0224404 | A1 | 9/2010 | Rippel et al. | |
| 2011/0013405 | A1* | 1/2011 | Buse | F21V 21/34 362/365 |

* cited by examiner

METHOD AND APPARATUS FOR RETROFIT MOUNTING AND WIRING SMALL APERTURE RECESSED LIGHTING

CROSS-REFERENCE TO PRIOR APPLICATIONS

This application is the U.S. National Phase application under 35 U.S.C. § 371 of International Application No. PCT/IB2014/060823, filed on Apr. 18, 2014, which claims the benefit of U.S. Provisional Patent Application No. 61/815,550, filed on Apr. 24, 2013. These applications are hereby incorporated by reference herein.

TECHNICAL FIELD

Generally, a LED lighting fixture is disclosed. More specifically, various apparatus are disclosed herein that relate to a LED lighting fixture that may be installed or retrofit into, for example, a preexisting ceiling recess.

BACKGROUND

Digital lighting technologies, i.e. illumination based on semiconductor light sources, such as light-emitting diodes (LEDs), offer a viable alternative to traditional fluorescent, HID, and incandescent lamps. Functional advantages and benefits of LEDs include high energy conversion and optical efficiency, durability, lower operating costs, and many others. Recent advances in LED technology have provided efficient and robust full-spectrum lighting sources that enable a variety of lighting effects in many applications. Some of the fixtures embodying these sources feature a lighting module, including one or more LEDs capable of producing any of a variety of optical outputs. For example, LEDs may be used to create direct down light, wall wash, spotlighting, or any of a variety of optical outputs. Further, colorful lighting may be produced in any of a variety of colors.

However, replacing existing non-digital lighting with LEDs, or replacing LEDs with other LEDs can be difficult in some applications. For example, recessed lighting fixtures in ceilings may require cutting and patching of drywall in order to replace the fixture. This is often unacceptable because patching and/or cutting of drywall leaves visible remnants that are unappealing. Thus, it may be necessary to replace an entire ceiling, or a large portion of ceiling, in order to replace the recessed lighting fixture.

Thus, there is a need in the art to provide a LED lighting fixture that overcomes these issues.

SUMMARY

The present disclosure is directed generally to apparatus for a LED lighting fixture. For example, in some embodiments a LED lighting fixture is provided that may be retrofit into an existing recess for a light source. The retrofit lighting fixture may have dimensions larger than the recess into which it is to be installed, but may nonetheless be installed through the smaller or pre-existing recess by utilizing the design and/or features disclosed herein.

Generally, in one aspect, a LED lighting fixture is provided that includes a luminaire housing for receiving and attaching a junction box and a light engine module (LEM). The luminaire housing defines an internal cavity and also has an opening and a top wall opposite the opening. The luminaire housing has a first side between the opening and the top wall wherein the first side has an opening for receiving a junction box therethrough such that the junction box may be mated to the luminaire housing. The junction box contains a power supply and also includes a face plate that is removably affixed to the junction box by at least one affixation mechanism. The LEM includes at least one light emitting diode (LED) and is removably retained within the internal cavity of the luminaire housing. The LEM includes a side wall and a light exit aperture that is covered by a lens, as well as a second top wall and a planar support member mounted to the second top wall. The LED is mounted on the planar support member which is positioned adjacent to the second top wall. The LEM has at least one first clip that extends into the luminaire housing. There is at least one second clip attached to the luminaire housing. The first clip and the second clip frictionally engage one another and are separable by a pulling force.

In some embodiments, the second clip may be removably attachable to the top wall of the luminaire housing. Further, the second clip may engage one more apertures in the top wall of the luminaire housing. The luminaire housing may extend longitudinally from a first end to a second end so that the internal cavity is substantially rectangular. The junction box may have one or more knockouts. The face plate of the junction box may be adjacent the internal cavity of the luminaire housing. Further, the power supply may be interposed between the face plate and a wiring cavity of the junction box. There may be a heat dissipating structure attached to the second top wall which includes one or more fins that extend into the internal cavity of the luminaire housing.

Generally, in another aspect, a LED lighting fixture is provided that includes a luminaire housing for receiving and attaching a junction box and a light engine module (LEM). The luminaire housing has an opening and a top wall with apertures that is opposite the opening. The luminaire housing defines an internal cavity and has a first side member that includes a junction box aperture. The junction box is matingly received in the junction box aperture and includes a power supply and a removable face plate. The LEM includes at least one LED and is located within the internal cavity of the luminaire housing. The LEM also has a light exit aperture and a second top wall with a planar support member mounted to the second top wall. The LEM has one or more spring clips that extend into the luminaire housing. The spring clips are removably supported in the luminaire housing so that the LEM may be separated from the luminaire housing by a pulling force.

In some embodiments, the spring clips may be removably attachable to the top wall of the luminaire housing. Further, the spring clips may engage one or more apertures of the top wall of the luminaire housing. The spring clips may include interceding spring clips that attach to the top wall of the luminaire housing. The removable face plate of the junction box may be adjacent the internal cavity of the luminaire housing. The face plate may have an outer perimeter that is smaller and within an outer perimeter of the junction box aperture of the luminaire housing. The power supply may be adjacent the face plate and interposed between the face plate and a wiring cavity of the junction box. There may be included one or more heat dissipating fins that extend into the luminaire housing.

Generally, in another aspect, a LED lighting fixture is provided that includes a luminaire housing for receiving and attaching a junction box and a light engine module (LEM). The luminaire housing has an opening and a top wall with apertures opposite the opening. The luminaire housing has a first member with a junction box aperture and the luminaire housing defines an internal cavity. The junction box is for receiving external wiring. The LEM has at least one LED and is in the internal cavity of the luminaire housing. The LEM has a light exit aperture and a planar support member mounted to a second top wall of the LEM. The LED(s) are mounted to the planar support member. The LEM has one or more compressible spring clips that are attached in the luminaire housing by an interference fit in such a way as to be separable from the luminaire housing by a pulling force.

In some embodiments, the compressible spring clips may be separably attached to the top wall of the luminaire housing. The spring clips may engage the top wall aperture(s) of the luminaire housing top wall. The spring clips may include interceding spring clips that attach to the top wall of the luminaire housing.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyroluminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "spectrum" should be understood to refer to any one or more frequencies (or wavelengths) of radiation produced by one or more light sources. Accordingly, the term "spectrum" refers to frequencies (or wavelengths) not only in the visible range, but also frequencies (or wavelengths) in the infrared, ultraviolet, and other areas of the overall electromagnetic spectrum. Also, a given spectrum may have a relatively narrow bandwidth (e.g., a FWHM having essentially few frequency or wavelength components) or a relatively wide bandwidth (several frequency or wavelength components having various relative strengths). It should also be appreciated that a given spectrum may be the result of a mixing of two or more other spectra (e.g., mixing radiation respectively emitted from multiple light sources).

For purposes of this disclosure, the term "color" is used interchangeably with the term "spectrum." However, the term "color" generally is used to refer primarily to a property of radiation that is perceivable by an observer (although this usage is not intended to limit the scope of this term). Accordingly, the terms "different colors" implicitly refer to multiple spectra having different wavelength components and/or bandwidths. It also should be appreciated that the term "color" may be used in connection with both white and non-white light.

The term "color temperature" generally is used herein in connection with white light, although this usage is not intended to limit the scope of this term. Color temperature essentially refers to a particular color content or shade (e.g., reddish, bluish) of white light. The color temperature of a given radiation sample conventionally is characterized according to the temperature in degrees Kelvin (K) of a black body radiator that radiates essentially the same spectrum as the radiation sample in question. Black body radiator color temperatures generally fall within a range of from approximately 700 degrees K (typically considered the first visible to the human eye) to over 10,000 degrees K; white light generally is perceived at color temperatures above 1500-2000 degrees K.

Lower color temperatures generally indicate white light having a more significant red component or a "warmer feel," while higher color temperatures generally indicate white light having a more significant blue component or a "cooler feel." By way of example, fire has a color temperature of approximately 1,800 degrees K, a conventional incandescent bulb has a color temperature of approximately 2848 degrees K, early morning daylight has a color temperature of approximately 3,000 degrees K, and overcast midday skies have a color temperature of approximately 10,000 degrees K. A color image viewed under white light having a color temperature of approximately 3,000 degree K has a relatively reddish tone, whereas the same color image viewed under white light having a color temperature of approximately 10,000 degrees K has a relatively bluish tone.

The term "lighting fixture" is used herein to refer to an implementation or arrangement of one or more lighting units in a particular form factor, assembly, or package. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). A "LED lighting unit" refers to a lighting unit that includes one or more LED-based light sources as discussed above, alone or in combination with other non LED-based light sources.

It should be appreciated that all combinations of the foregoing concepts and additional concepts discussed in greater detail below (provided such concepts are not mutually inconsistent) are contemplated as being part of the subject matter disclosed herein. In particular, all combinations of claimed subject matter appearing at the end of this disclosure are contemplated as being part of the subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale.

DETAILED DESCRIPTION

In the following detailed description, for purposes of explanation and not limitation, representative embodiments disclosing specific details are set forth in order to provide a thorough understanding of the description. However, it will be apparent to one having ordinary skill in the art having had the benefit of the present disclosure that other embodiments according to the present teachings that depart from the specific details disclosed herein remain within the scope of the appended claims. Moreover, descriptions of well-known apparatus and methods may be omitted so as to not obscure the description of the representative embodiments. For example, aspects of the methods and apparatus disclosed herein are illustrated in conjunction with a lighting fixture having a particular generally rectangular housing. However, one or more aspects of the methods and apparatus described herein may optionally be implemented in other housing configurations such as, for example, housings having a differing number of interior surfaces, housings having one or more non-planar surfaces, housings having an alternative light output opening, and/or housings having a different overall shape. Implementation of one or more aspects of a LED lighting fixture described herein with alternatively configured housings is contemplated herein.

Figure 4:
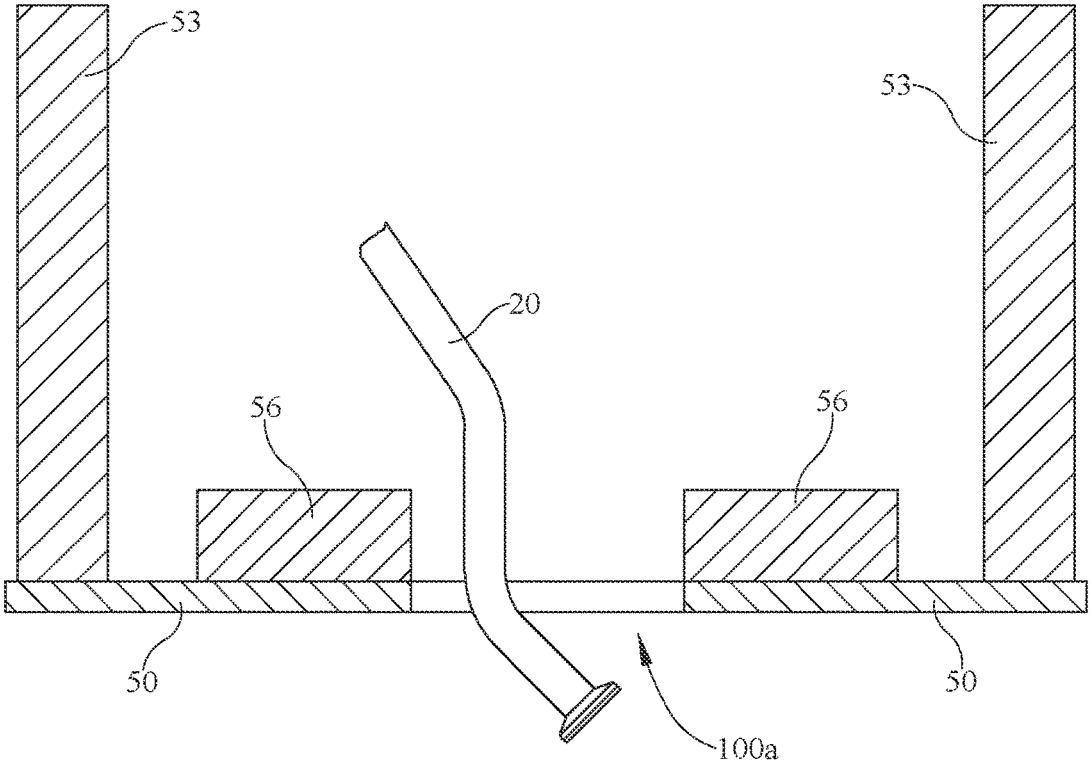
FIG. 4 illustrates a cross-sectional front view of a ceiling and a power supply conduit.

Embodiments may further be understood with reference to FIG. 4, which illustrates a typical structural support including ceiling 50, joists 53, and struts 56. It is understood that this is merely an exemplary arrangement and any of a variety of ceiling or other structures may be the structural support in which a recessed lighting fixture or any other light source or illumination source is installed. In some applications, it may be desirable, for any of a variety of reasons, to install a recessed lighting fixture either as a new installation or as a retrofit of an existing recessed or other lighting fixture. In such cases, there may be space or other constraints, such as, for example, an opening 100*a* in a ceiling 50. However, expanding the opening 100*a* in or above ceiling 50 is often impractical because it may result in damage or unsightly modifications to ceiling 50 or other structure. For example, if ceiling 50 is drywall, cutting and patching may be noticeable and therefore undesirable. Alternatively, replacement of large sections of drywall ceiling may be cost prohibitive. Thus, in many cases, the opening

100*a* in and above ceiling 50 may be severely limited and thus any retrofit will be likewise severely limited.

Figure 1:
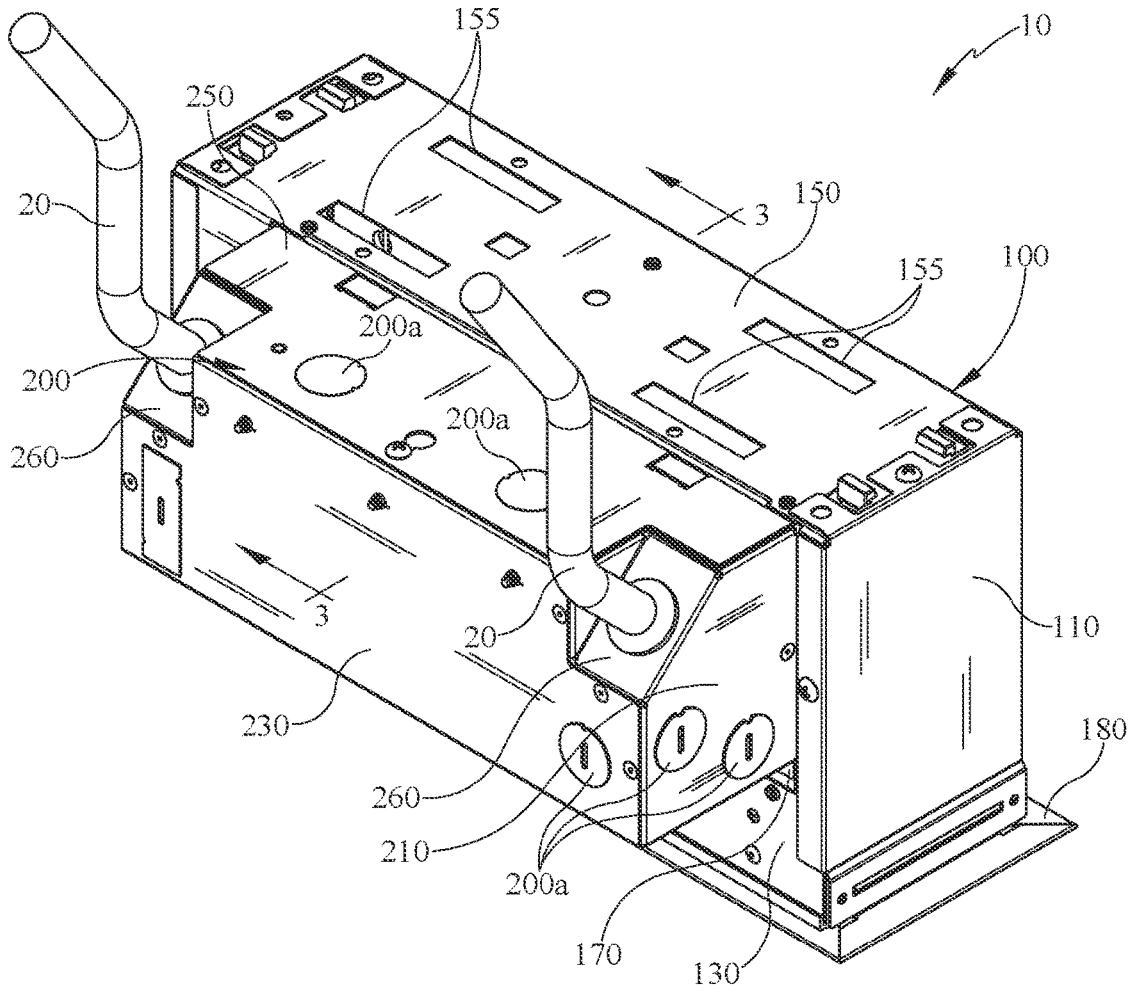
FIG. 1 illustrates a perspective view of an embodiment of a retrofit LED lighting fixture.
Figure 2:
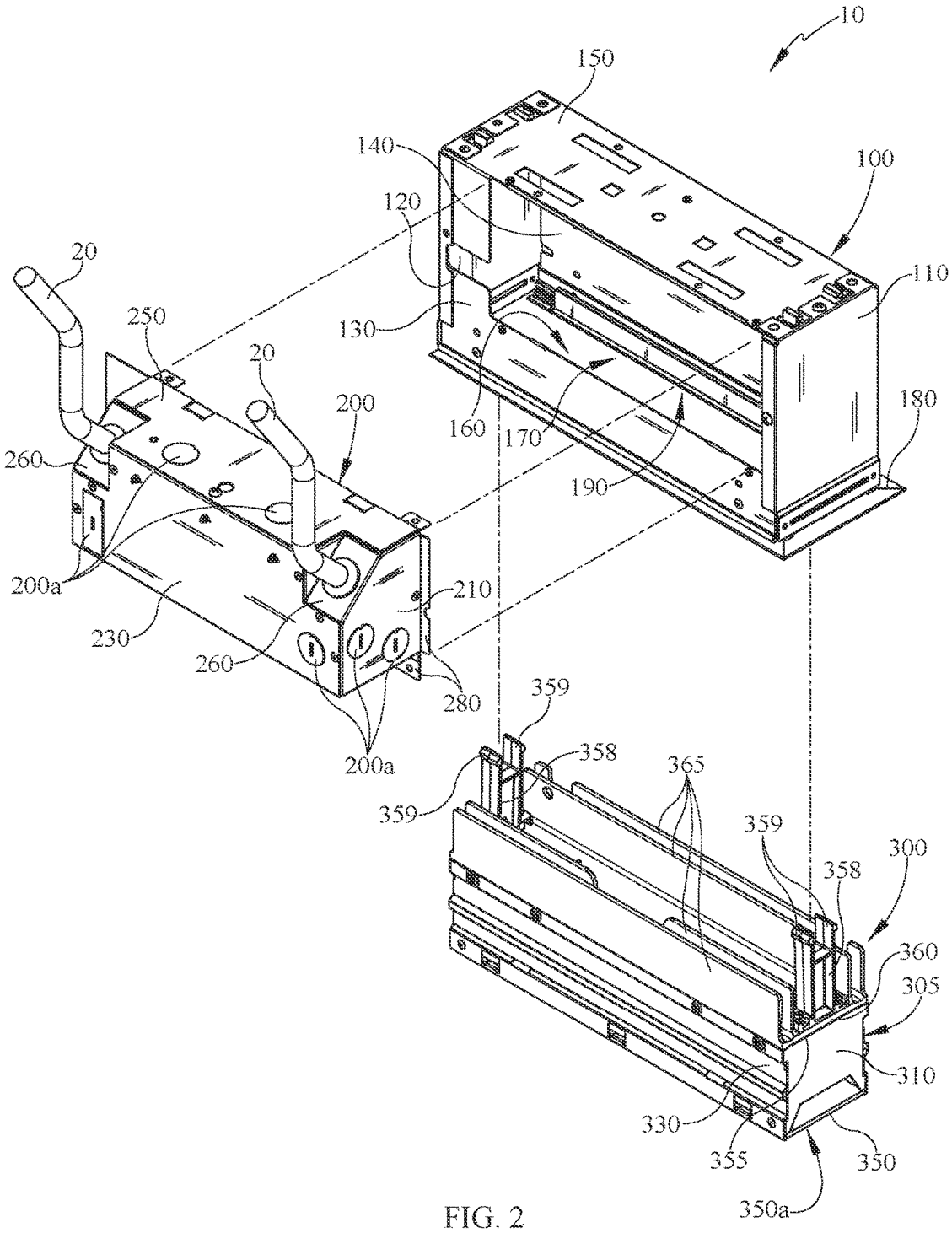
FIG. 2 illustrates an exploded perspective view of the retrofit LED lighting fixture of FIG. 1.
Figure 3:
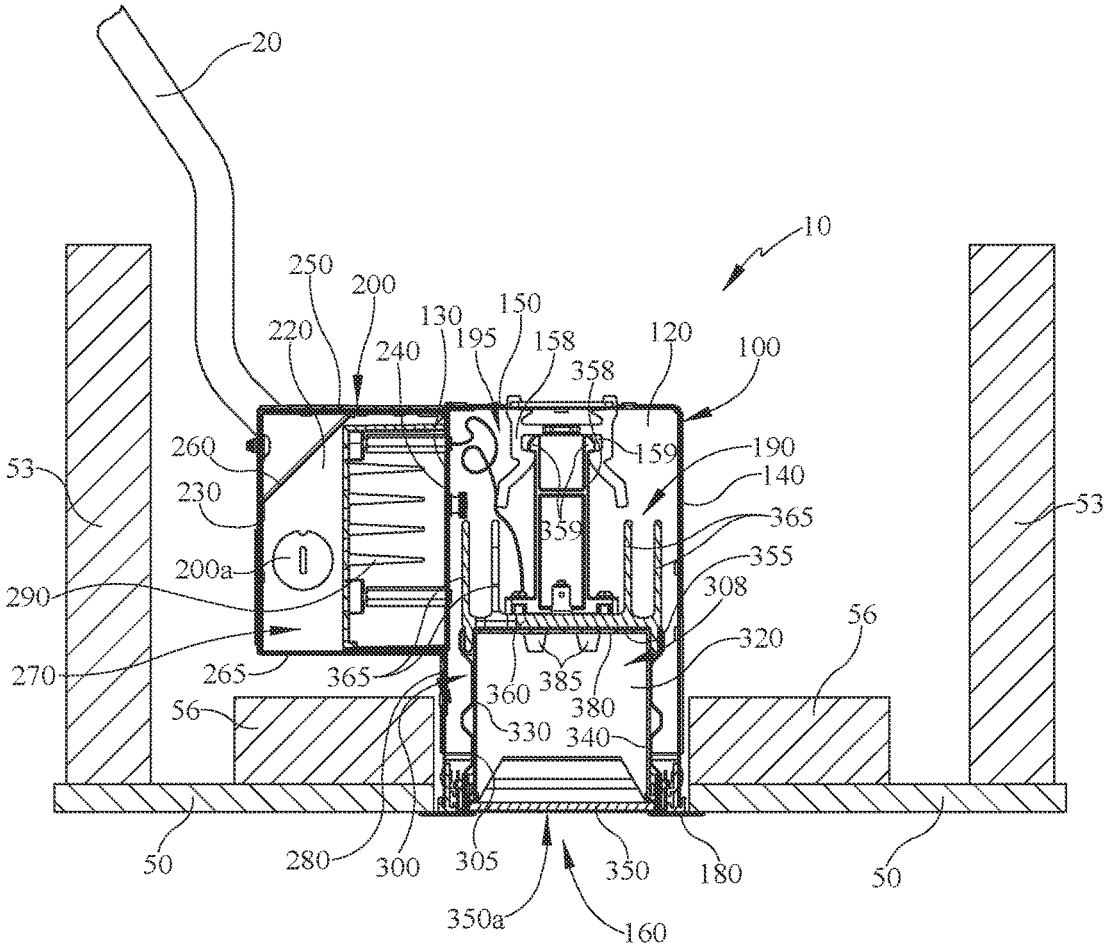
FIG. 3 illustrates a cross-section view of the retrofit LED lighting fixture of FIG. 1 taken along line 3-3 installed in an embodiment of a ceiling.

Referring now to FIGS. 1-3, an embodiment of a LED lighting fixture 10 is illustrated that may be retrofit to, for example, opening 100*a* in ceiling 50. LED lighting fixture 10 is illustrated as having a substantially asymmetrical configuration created by luminaire housing 100, junction box 200, and light engine module (LEM) 300. This configuration may fit within space constraints created by ceiling 50, joist 53, and struts 56, or other structure. Although illustrated as substantially wider than opening 100*a*, primarily due to the horizontally offset configuration of junction box 200, LED lighting fixture 10 and respective components may be sized and configured to be installed through opening 100*a* (see FIG. 4) in ceiling 50 without significant modification to the opening. As discussed in more detail herein, junction box 200 may be pre-wired to existing external wiring 20, transferred through luminaire housing 100, attached to luminaire housing 100, and light engine module 300 may be installed within luminaire housing 100. LEM 300, or any other feature of LED lighting fixture 10, may serve as a light source or illumination source, and thus may replace an existing light source or illumination source. The configuration illustrated of LED lighting fixture 10 may also allow inclusion of any or all of a LED-suitable power supply 290, junction box wiring cavity 270, heat sink 360 and/or fins 365, an internal cavity 190, LEM clips 358 and/or luminaire housing clips 158, without undue size limitations on any or all of these components. Heat sink 360 and/or fins 365 may be included as heat dissipation structure facilitating transfer of heat and/or energy away from PCB 380 and/or LEDs 385. Heat sink 360 and fins 365 may be one piece or separate pieces. In this way, LED lighting fixture 10 may be retrofit without excessive size and/or performance limitations. In some embodiments, any or all of luminaire housing 100, junction box 200, and LEM 300 may be substantially formed of sheet metal. It is understood, however, that any of a variety of materials may be used, including, but not limited to, plastic, rubber, wood, composites, and/or any of a variety of materials or a combination thereof.

Luminaire housing 100 may be a substantially longitudinally extending rectangular box defining internal cavity 190. It is understood that luminaire housing 100 may take any of a variety of shapes, including, but not limited to rectangular, conical, cylindrical, round, spherical, or any other shape. If rectangular, as shown, luminaire housing 100 may extend longitudinally from a first end or front member 110 to a second end or back member 120. Although it is understood that luminaire housing 100 may extend longitudinally to any of a variety of lengths, some embodiments may be about 1 ft. or 300 mm in length. Alternatively, in some embodiments this length may be about 4 ft. or 1200 mm. In this way, luminaire housing 100 may be made to readily retrofit a pre-existing light source or recess. However, it will be readily apparent to those of ordinary skill in the art that any of a variety of lengths may be used. Front member 100 and/or back member 120 may be substantially planar walls, if luminaire housing 100 is rectangular, and may be substantially solid to act to enclose the front and/or rear sides of luminaire housing 100. Luminaire housing 100 may extend transversely from first side member 130 to second side member 140. First side member 130 may include a junction box aperture 170 that is sized and configured to allow junction box 200 to pass substantially therethrough and/or to allow affixing of junction box 200 to luminaire housing 100.

Luminaire housing 100 may include an opening 160 and/or a top wall 150. Luminaire housing opening 160 may be sized and configured to allow insertion of junction box 200 and/or LEM 300 to pass therethrough. Similarly, internal cavity 190 may be sized to allow junction box 190 to be transferred therethrough and/or to allow LEM 300 to be installed therein. It is understood that front, rear, first side, and/or second side members 110, 120, 130, 140 and/or top wall 150 may contain apertures, slots, holes, or the like for any of a variety of reasons including, but not limited to, allowing ventilation and/or heat dissipation of luminaire housing 100. For example, top wall 150 may include top wall apertures 155 for reasons previously discussed and/or to provide an attachment location for LEM 300, which is discussed in more detail herein. It is further understood that front member 110, back member 120, second side member 140, and/or top wall 150 may be substantially solid and/or enclose luminaire housing 100. Further, if junction box aperture 170 is included luminaire housing first side member 130, first side member 130 may be otherwise solid or it may contain holes, slots, apertures, or the like. Luminaire housing 100 may include one or more opening lips 180. Opening lips 180 may be adjacent luminaire housing opening 160 and may extend outwardly therefrom. In this way, opening lips 180 may provide an attachment location for attaching luminaire housing 100 to ceiling 50 without substantially interfering with opening 160. In some embodiments, opening lips 180 may be snap-in formed trim made of metal or any other of a variety of materials, including, but not limited to, plastic, wood, rubber, or any other material or combination thereof. Thus, opening lips 180 may be removably attached and/or installed after the LEM housing 305 has been installed and, among other things, may finish off the appearance of LED lighting fixture 10 after LEM 300 is installed.

Junction box 200 may be a substantially box shaped structure formed by any or all of front member 210, back member 220, first side member 230, face plate 240, top member 250, inclined surfaces 260, and/or bottom member 265. Junction box 200 may define an internal space that may house power supply 290 and may include wiring cavity 270. Junction box 200 may be sized and configured to pass through junction box aperture 170 and/or junction box 170 may matingly receive junction box 200 by mating, for example, by junction box lips 280 overlapping luminaire housing first side member 130 and/or top wall 150. It is understood that this is merely an example and junction box 200 may take any of a variety of shapes, including, but not limited to, square, rectangular, polygonal, prismatic, round, cylindrical, spherical or any other shape or combination thereof. Junction box 200 may form a friction fit within junction box aperture 170 instead of, or in addition to, mating via junction box lips 280 and first side member 130 and/or top wall 150. Alternatively, junction box 280 may be removably secured in position within junction box aperture 170 by hinges and/or biasing clips or springs. It is understood that any of a variety of mechanisms may be used to secure, removably or otherwise, junction box 200 within junction box aperture 170 and/or to luminaire housing 100. Face plate 240 may be positioned adjacent to internal cavity 190 of luminaire housing 100 and/or be interposed between power supply 290 and internal cavity 190. Face plate 240 may be dimension to have an outer perimeter that is no larger than an outer perimeter of junction box aperture 170. In this way, face plate 240 may be attached, removed, and/or re-attached to junction box 200. However, it is understood that, in some embodiments, face plate 240 may be larger than junction box aperture 170 and/or be sized and/or configured independently of junction box aperture 170. To aid in attachment and/or removal of face plate 240 to the rest of junction box 200, an affixation mechanism such as, for example, thumb screws 240*b* may be used. Thumb screws 240*b* may provide a convenient way to remove and/or attach face plate 240 by hand, although it is understood that thumb screws 240*b* are merely one example of an affixation mechanism that may be used. Other examples may include, but are not limited to, wingnuts, clips, snaps, buttons, screws, bolts, nuts, and/or any other affixation mechanism. Face plate 240 may include an output aperture 240 that may allow a power supply cable 390*c* to pass through face plate 240. In this way, power supply cable 390*c* may operatively connect power supply 290 to LEM module 300 to power and/or light LEDs 385. For example, power supply cable 390*c* may supply power and/or provide a data connection between power supply 290 and LEM 300. Yet, power supply 290 may be substantially enclosed by junction box 200 including face plate 240, which may be required in some applications.

Junction box 200 may include one or more knockouts 200*a*. Knockouts 200*a* may act as removable portions of junction box 200 allowing access to the internal space defined by junction box 200, such as, for example, wiring cavity 270. In some embodiments, knockouts 200*a* may be slotted and/or allow insertion of a screwdriver tip or other device to turn and remove knockouts 200*a*. It is understood that knockouts 200*a* may be made removable and/or attachable to junction box 200*a* in any of a variety of ways, including, but not limited to, by hand, screwdriver, or other implement. Knockouts 200*a* may be located on any or all of junction box front member 210, back member 220, first side member 230, top member 250, inclined surface 260, and/or bottom member 265. Having multiple knockouts 200*a* in more than one side of junction box 200 may allow versatility in connecting external wiring 20 to junction box 200 and thereby LED lighting fixture 10. Further, having multiple knockouts 200*a* may allow chaining, linking, and/or serial connection of a plurality of LED lighting fixtures operatively connected to power LEDs 385 by as few as one external wire, such as, for example, external wiring 20. If multiple LED fixtures 10 are connected, multiple instances of external wiring, such as is illustrated in FIGS. 1 and 2, may be included, any or all of which may carry power into LED lighting fixture 10 from an external source and/or transfer power from one LED lighting fixture 10 to another LED lighting fixture 10.

LEM 300 may be sized and configured to be inserted, installed, and/or supported by luminaire housing 100 so as to operate to cast light outwardly, such as, for example, through luminaire housing opening 160. LEM 300 may include any or all of a LEM housing 305, an optical cavity 308, a front member 310, a back member 320, a first side 330, a second side 340, a light exit aperture 350*a*, a lens 350, a second or LEM top wall 355, first or module clips 358, heat sink 360 and/or fins 365, planar support member or printed circuit board (PCB) 380, and/or one or more LEDs 385. In some embodiments, LEM 300 may extend longitudinally from front member 310 to back member 320 to define internal optical cavity 308 and/or be similarly dimensioned to luminaire housing 100. Any or all of front member 310, back member 320, first side 330, and second side 340 may form a side wall of LEM 300. LEM 300 may be undersized longitudinally and/or transversely in relation to luminaire housing 100 to facilitate insertion, installation, attachment, and/or removal of LEM 300 in luminaire housing 100. LEDs 385 may be supported by planar support member 380 and thereby retained in position within optical cavity 308. In some embodiments, planar support member 380 may be a PCB, in which embodiments planar support member or PCB 380 may operate and/or control LEDs 385. LEDs 385 and/or PCB 380, may be powered or operatively connected to power supply 290 by, for example, power supply cable 390*c*. It is understood that this is merely one way to transmit power to LEDs 385 and/or PCB 380, and that any of a variety of power transmittal mechanisms may be used. LEM 300 may include light exit aperture 350*a* to, for example, allow light to be outwardly cast from LEM 300. In some embodiments, light exit aperture 350*a* may be oriented downwardly to allow light to be cast from LEM 300 downwardly, such as, for example, if LED light fixture 10 were to be used overhead and/or in ceiling 50.

LEM 300 may be removably attached, installed, and/or connected to luminaire housing 100 by use of, for example, luminaire housing clips 158 and/or LEM clips 358. In some embodiments, LEM clips 358 and/or luminaire housing clips 158 may be spring or compressible clips that extend toward luminaire housing 100. In some embodiments, luminaire housing clips 158 may be sized and/or configured to correspondingly mate with LEM clips 358. For example, LEM clips 358 may be cantilevered or otherwise made to be compressible and/or spring at an end near the luminaire housing 100. In this example, luminaire housing clips 158 may contain notches 159. This end of LEM clips 358 may contain outwardly extending protrusions 359. Thus, squeezing or compressing LEM clips 358 may allow insertion into luminaire housing clips 158. Releasing or seizing the compression may allow LEM clips 358 to spring outwardly thus allowing protrusions 359 to engage notches 159, thereby securing LEM 300 in position within luminaire housing 100. Further, this configuration may allow removability and/or separation of LEM 300 from luminaire housing 100, such as, for example, applying a pull force P via removal tool 400 (see FIGS. 10 and 11). Removal of LEM 300 from luminaire housing 100 via application of pull force P to removal tool 400, if removal tool 400 is used, is described in more detail herein.

Clips 158, 358 may form an interference or friction fit and/or frictionally engage one another while they are in contact. In this way, clips 158, 358 may be removably attached and/or separable such that a pulling force may separate them as discussed in more detail herein. In some embodiments, insertion or engagement, and/or removal or disengagement, of LEM clips 358 from luminaire housing clips 158 may be facilitated by inclusion of angled or inclined surfaces on either or both clips 158, 358. For example, protrusions 159 may have surfaces that engage clips 158 at notches 159, and these surfaces of protrusions 159 may be angled relative to the direction of insertion $I_3$ (see FIG. 9) and/or direction of pull force P (see FIGS. 10 and 11). Thus, insertion or removal of LEM clips 358 from luminaire housing clips 158 may create a normal force in these angled surfaces capable of compressing LEM clips 358 and/or spreading luminaire housing clips 158 as LEM clips 358 pass through a narrow point or throat of luminaire housing clips 158. Subsequently, the normal force may be substantially removed when clips 158, 358 are no longer in contact at the narrow point of luminaire housing clips 158, which may result in outward springing of LEM clips 358 and/or inward springing of luminaire housing clips 358. In some embodiments, either or both of clips 158, 358 may be attached to or supported by luminaire housing 100, such as, for example, by top wall 150. It is understood, however, that clips 158, 358 may be supported by luminaire housing 100 other than by top wall 150 such as, for example, at any or all of front, back, first side, and/or second side members 110, 120, 130, 140. In some embodiments, luminaire clips 158 may be supported by top wall 150 by extending through top wall apertures 155 and resting or being supported by an outer or upper surface of top wall 150. In some embodiments, luminaire housing clips 158 may be an interceding spring clip, interceding between LEM clips or spring clips 358 and the point of support in or on luminaire house 100, such as top wall 150.

It is understood that LED lighting fixture 10 is not limited to ceiling mount orientations, and may be used in any of a variety of orientations, including, but not limited to, wall mount and/or floor mount orientations. Thus, in some embodiments, LED lighting fixture 10 may cast light upwardly, downwardly, horizontally, and/or at any angle relative thereto. Any or all of LEM front, back, first side, and/or second side members 310, 320, 330, 340 and/or LEM top wall 355 may be entire or partially reflective, such as, for example, on an inside surface substantially facing optical cavity 308. These reflective surfaces, if included, may facilitate transmittal of light from LEDs 385 outwardly through light exit aperture 350*a* and/or lens 350. Lens 350 may optionally be included for any of a variety of reasons, including, but not limited to, providing and/or enhancing light output, protecting any or all components of LED lighting fixture 10, and/or providing a safety measure to prevent, for example, electric shock or electrocution by contact with electricity. If included, lens 350 may substantially cover light exit aperture 350*a* and/or may be substantially translucent, transparent, and/or a diffusing lens. Lens 350*a* may be substantially planar as shown, although it is understood that lens 350 may be any of a variety of shapes including, but not limited to, prismatic and/or having a depth extending inwardly or outwardly from optical cavity 308, rounded, spherical, and/or any other shape. It is further understood that lens 350 may be colored, textured, and/or include features to, for example, provide a desired optical effect. It is understood that, although light exit aperture 350*a*, lens 350, and luminaire housing opening 160 are illustrated as substantially co-extensive and/or co-planar, it is understood that they are not so limited. Any or all of light exit aperture 350*a*, lens 350, and/or luminaire housing opening 160 may be offset in any direction relative to one another, may be smaller or larger than any other, may be transverse to one another, and/or may be sized and/or configured without any substantial relationship to any other. In other words, these Figures are merely exemplary and are not to be construed as limiting, as light exit aperture 350*a*, lens 350, and/or luminaire housing 160 may be designed and/or formed independently of one another.

LEM 300 may be made to have any of a number of optical or other features. Further, LEM 300 may be removably or separably attached to luminaire housing 100 as discussed herein. Thus, LED lighting fixture 10 may provide modularity by allowing removal of one LEM 300 and installation of another LEM 300 that, for example, may output any of a variety of different colors or spectra or other output. Examples of light outputs that may be provided by LED lighting fixture 10 and/or LEM 300 include, but are not limited to, direct down lighting, wall washing, spotlighting, and/or any of a variety of outputs. Further examples include varying translucency, output light color or spectrum, and/or varying color temperature to have a warmer or cooler feel by replacing LEM 300. In this way, optical output may be varied by replacing one LEM 300 with another LEM 300 without the need to replace luminaire housing 100 and/or junction box 200. Further, facilitated removal of LEM 300 may allow easier access to junction box 200 and/or power supply 290. It is common for the power supply, such as power supply 290, to fail before other components of a lighting fixture, thus it may be helpful in some embodiments to facilitate access to it.

Figure 10:
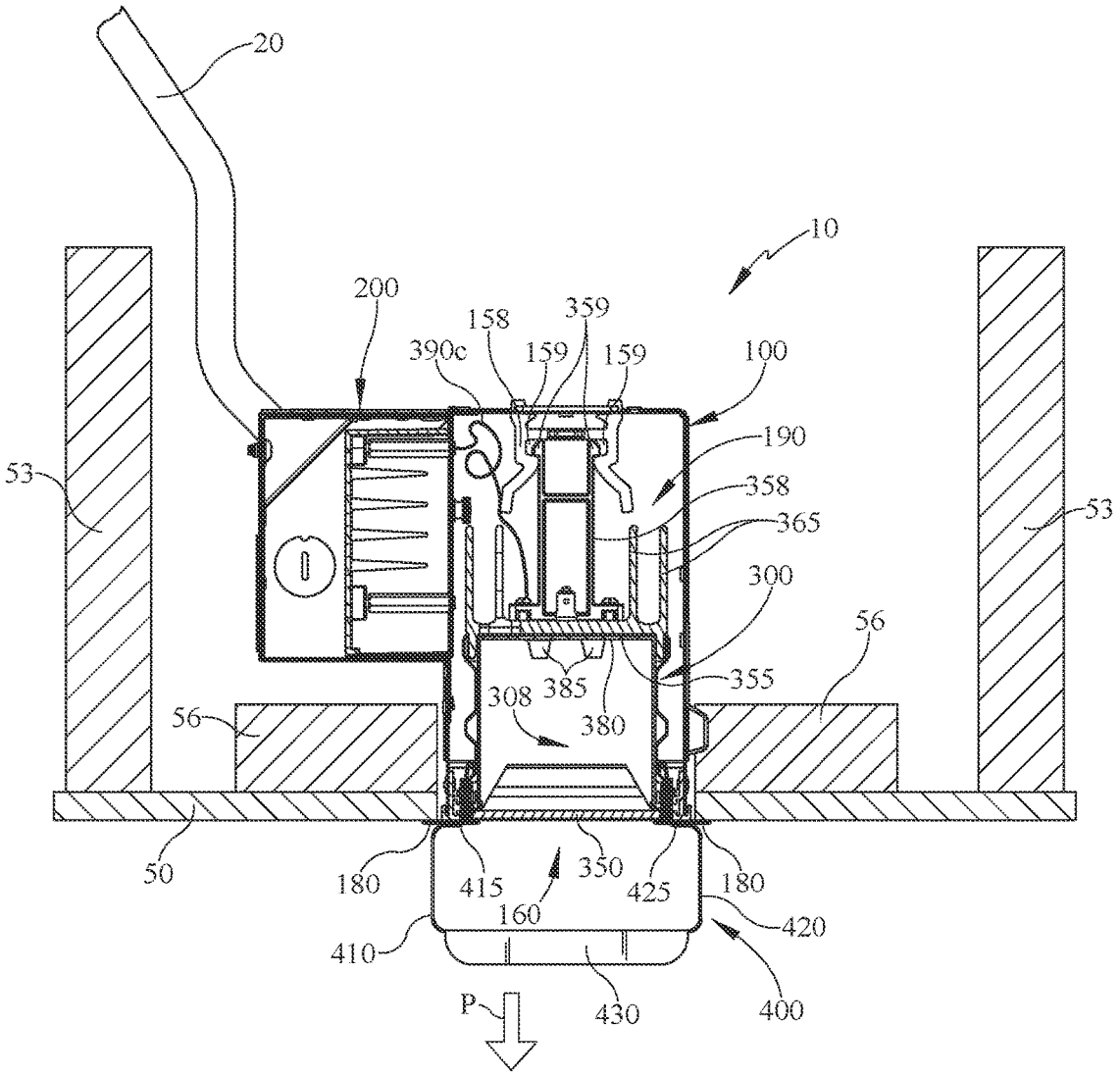
FIG. 10 illustrates the retrofit LED lighting fixture of FIG. 3, and an embodiment of a light engine module removal tool.
Figure 11:
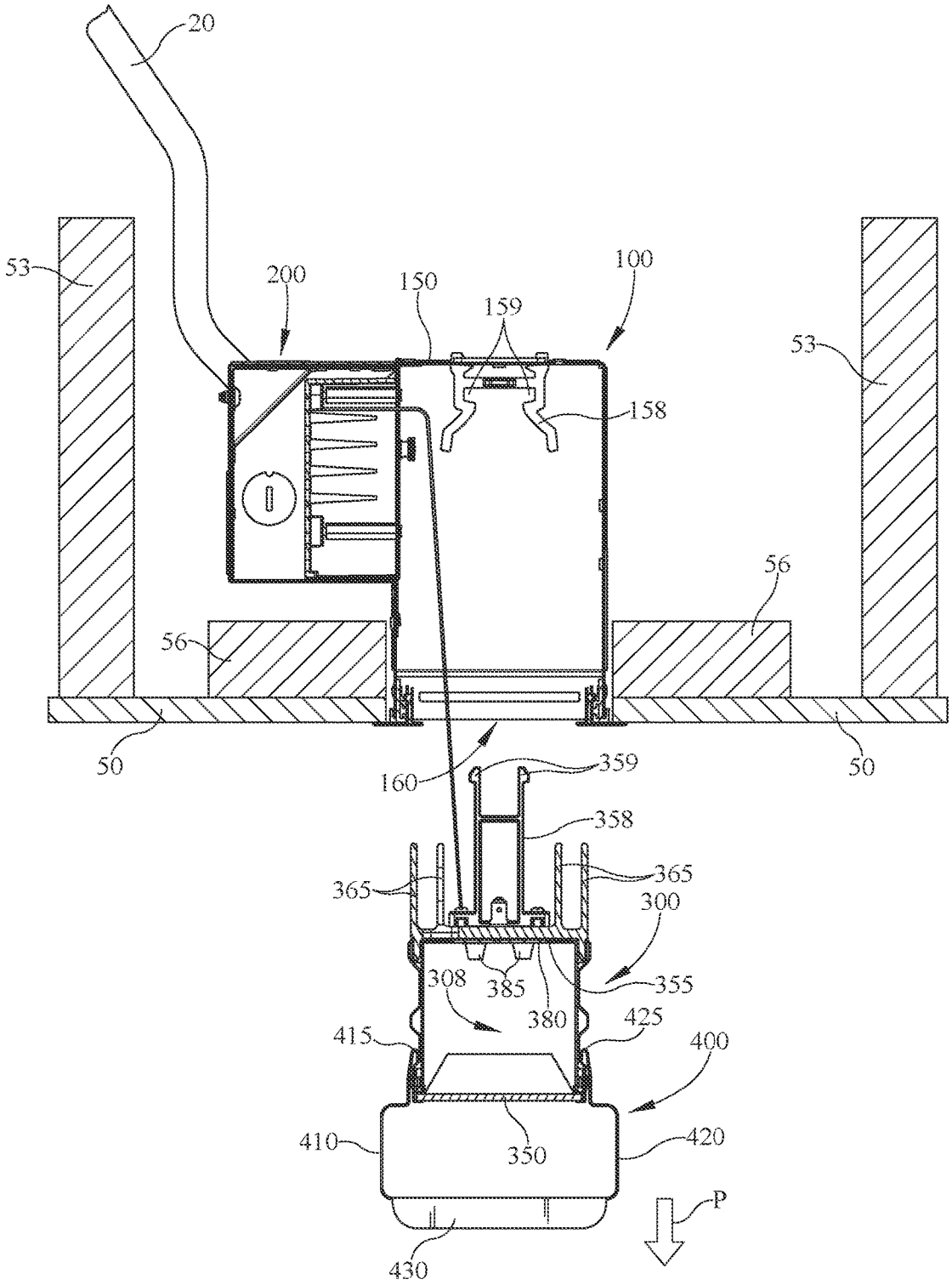
FIG. 11 illustrates the retrofit LED lighting fixture and light engine module removal tool of FIG. 10 in a variant orientation.

Referring now to FIGS. 10 and 11, an embodiment of LEM removal tool 400 is illustrated. Removal tool 400 may be used to facilitate removal of LEM 300 from luminaire housing 100. Removal tool 400 may be a substantially C-shaped device having a first end 410, a second end 420, and/or a handle 430. First end 410 may include a first tip 415 and/or a second end may include a second tip 425. Either or both of tips 415, 425 may be relatively narrow and/or rigid so as to facilitate removal of LEM 300 from luminaire housing 100 such as, for example, by applying a pull force P away from luminaire housing 100 at handle 430. In use, either or both of tips 415, 425 may be inserted between luminaire housing 100 and LEM 300 so that either or both of tips 415, 425 may grip or attach to LEM 300. Opening lips 180 may be removable from LEM housing 305 to facilitate insertion of removal tool 400 and/or tips 415, 425. For example, if opening lips 180 are formed from one or more snap-in pieces, then they may be removed to allow insertion of removal tool 400 and/or tips 415, 425, and may be re-attached to LEM housing 305 to, for example, finish off the appearance of the installed LED lighting fixture 10. Pull force P may be applied to pull LEM 300 out of luminaire housing 300. It is understood that removal tool 400 is merely an example of one way to remove LEM 300 from luminaire housing 100. LEM 300 may be removed from luminaire housing in any of a variety of ways, including, but not limited to, by hand, by any of a number of removal tools, and/or by any other implement.

Figure 5:
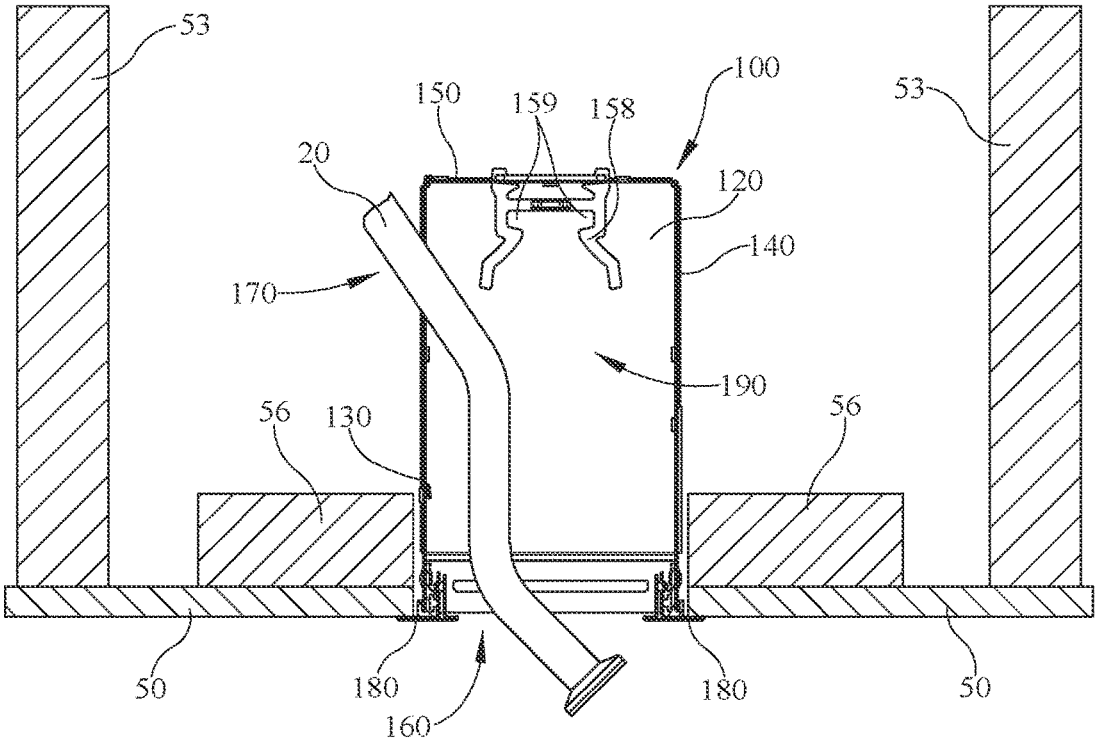
FIG. 5 illustrates the ceiling and power supply conduit of FIG. 5 and an embodiment of a luminaire housing.

Referring now to FIGS. 4-9, a step by step approach to retrofitting ceiling 50 with LED lighting fixture 10 is illustrated. If any light source or anything else is occupying the recess that is to accommodate LED lighting fixture 10, it may be removed thus opening ceiling aperture 100*a* and external wiring 20 may be pulled through ceiling aperture 100*a*, as shown in FIG. 4. External wiring 20 may take any of a variety of forms, including, but not limited to, a rigid or flexible conduit, cable harness, bare or wrapped wire, and/or any of a variety of other forms. As shown in FIG. 5, luminaire housing 100 may be inserted, attached, and/or installed in or on ceiling 50. External wiring 20 may be run through junction box aperture 170, internal cavity, and/or luminaire housing opening 160 thereby allowing installment of luminaire housing 100 and accessibility of external wiring 20. In some applications, luminaire housing 100 may be a reuse of the housing of any previously existing light source or other item or a modified version thereof. A modification, for example, may be to cut junction box aperture 170 and/or add top wall apertures 155 in the housing of a previously installed light source to substantially form luminaire housing 100.

Figure 6:
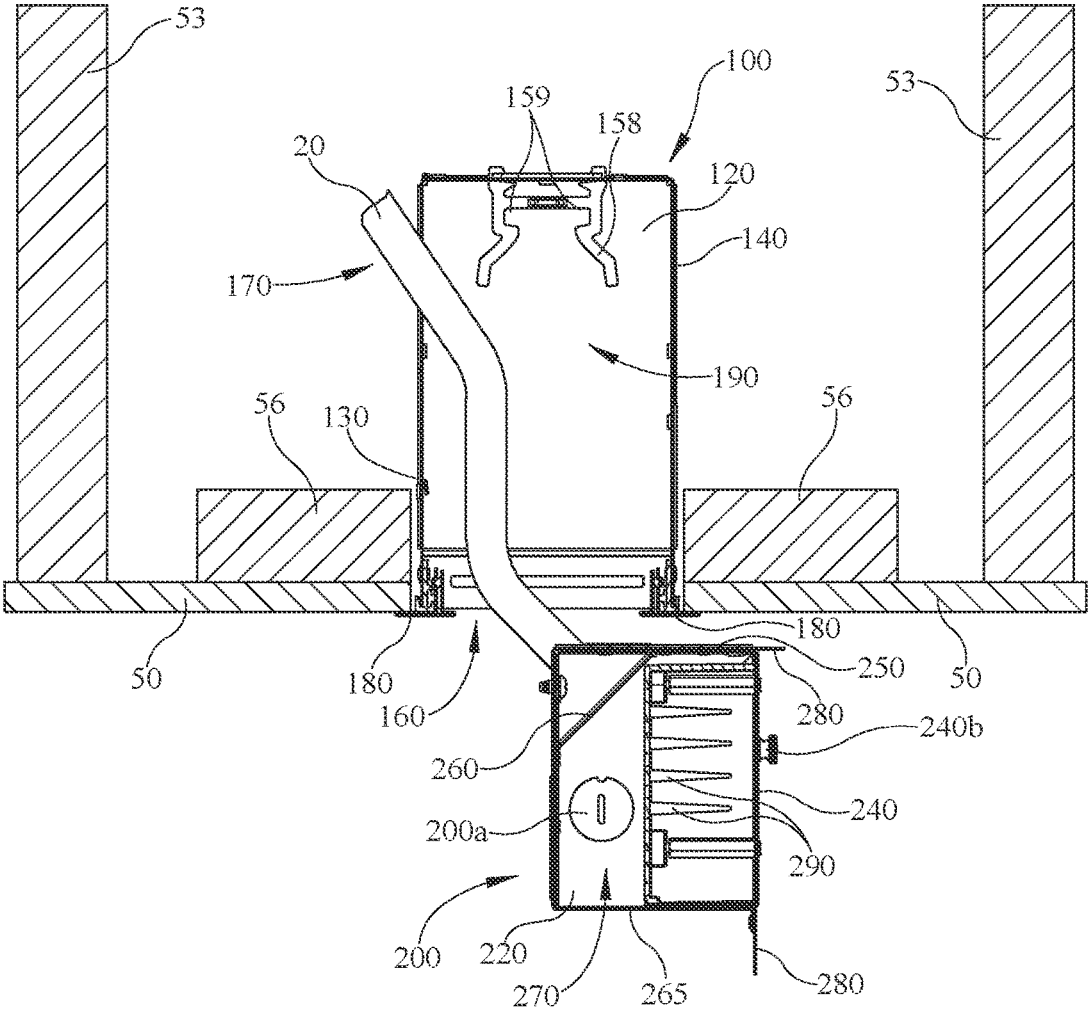
FIG. 6 illustrates the ceiling, power supply conduit, and luminaire housing of FIG. 5, and an embodiment of a junction box.
Figure 7:
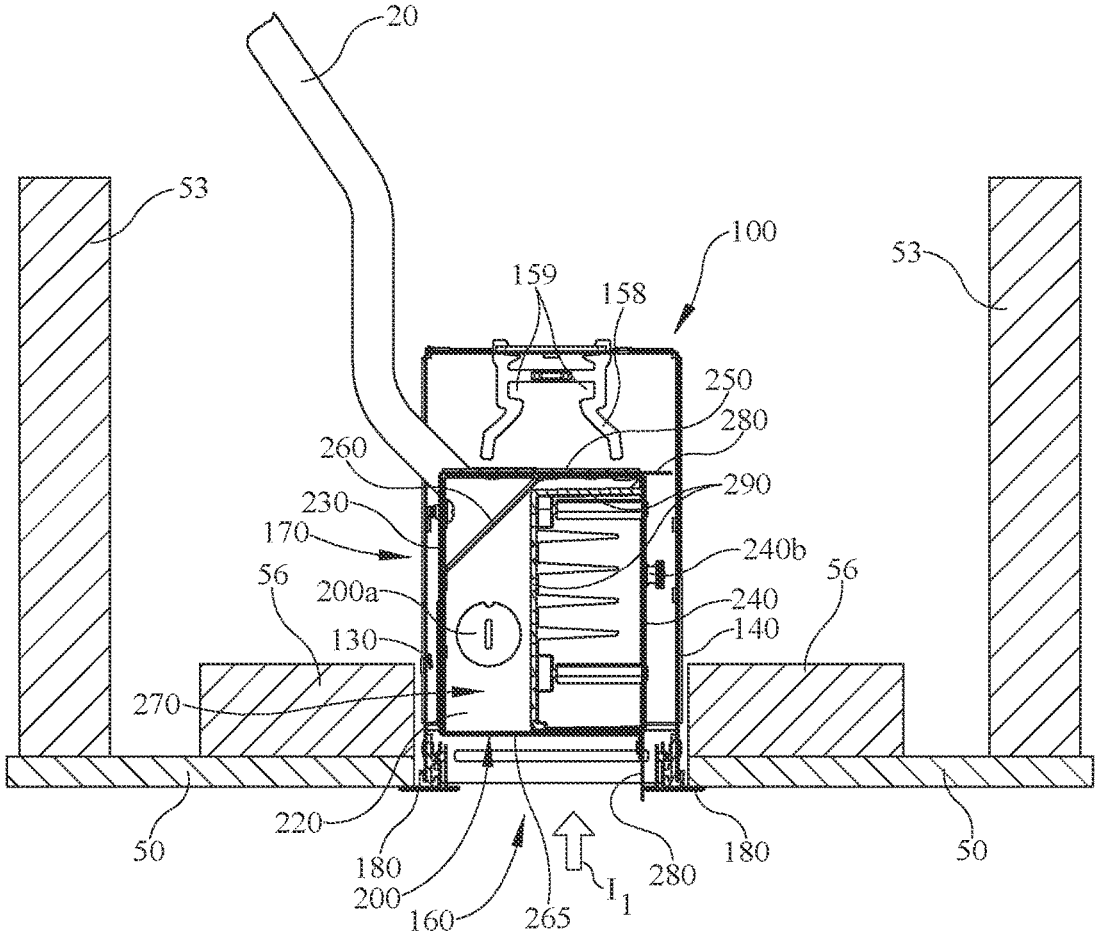
FIG. 7 illustrates the ceiling, power supply conduit, luminaire housing, and junction box of FIG. 6 in a variant orientation.
Figure 8:
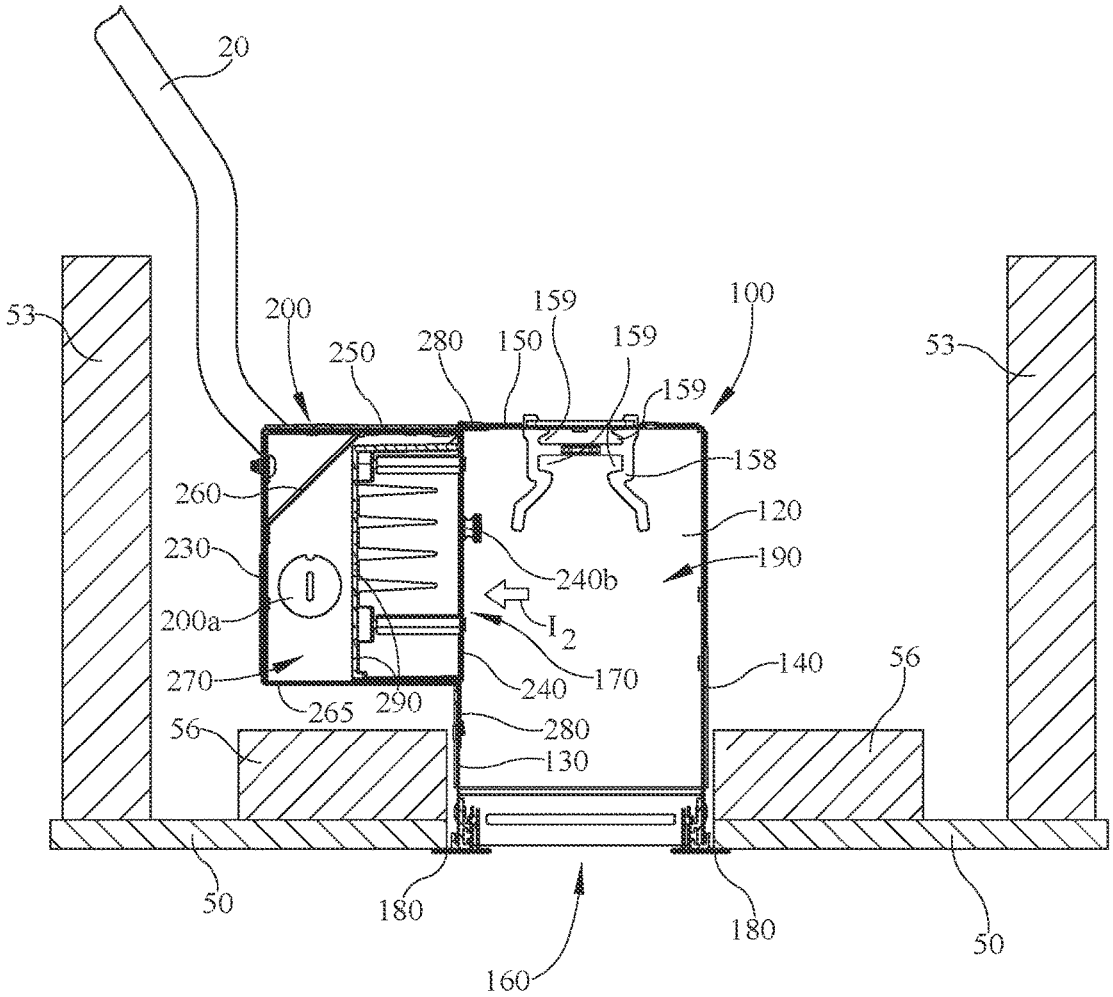
FIG. 8 illustrates the ceiling, power supply conduit, luminaire housing, and junction box of FIG. 6 in another variant orientation.
Figure 9:
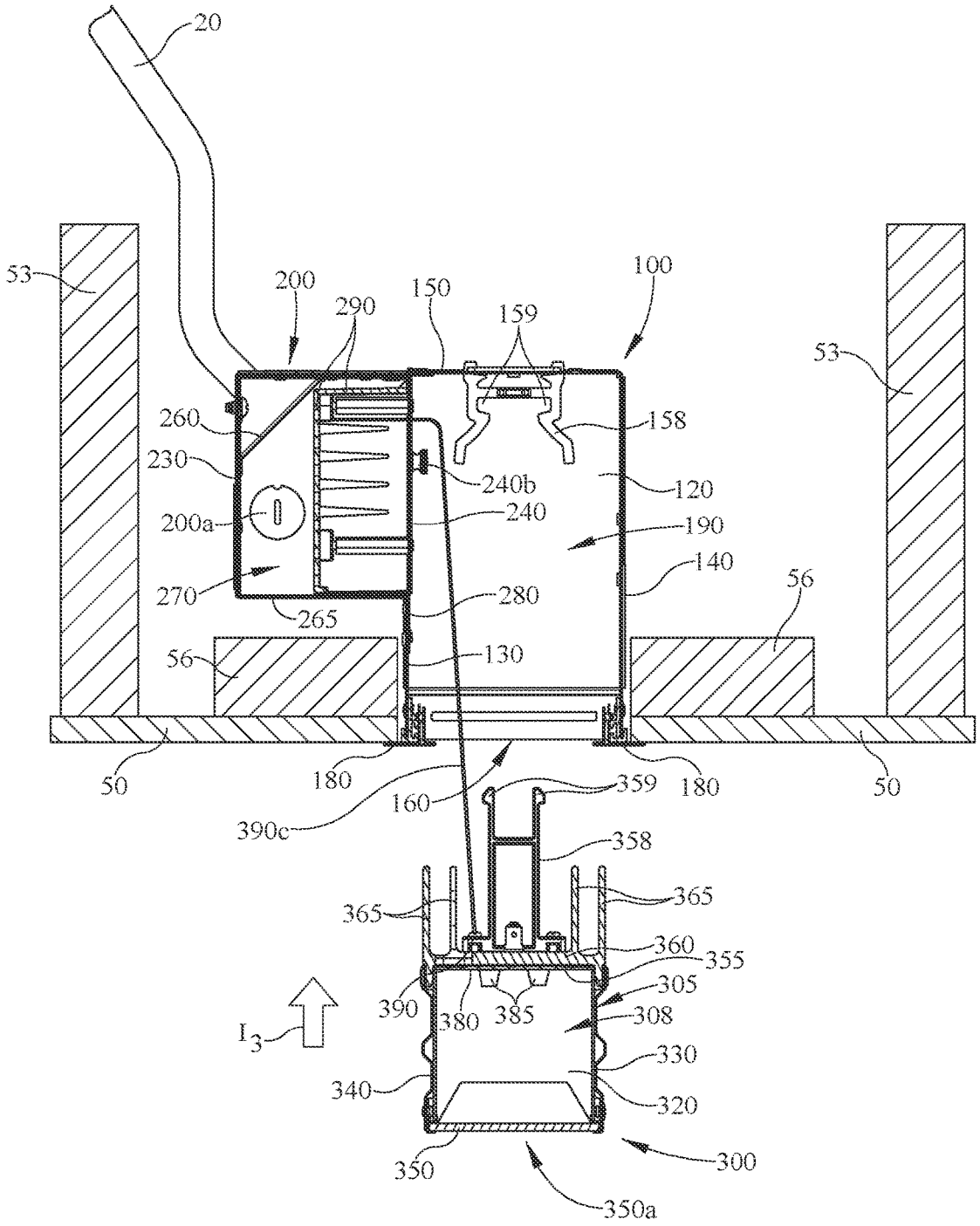
FIG. 9 illustrates the ceiling, power supply conduit, luminaire housing, and junction box of FIG. 8, and an embodiment of a light engine module.

As shown in FIG. 6, external wiring 20 may be operatively connected to junction box 200 via any one of knockouts 200*a*, such as knockouts 200*a* in inclined surface 260, as shown. Thus, external wiring 20 may provide electrical connection to junction box 200 and thereby to power supply 290 contained within junction box 200. Junction box 200 may be transferred in a first installation direction $I_1$ into internal cavity 190 of luminaire housing 100, as shown in FIG. 7. If opening lips 180 or trim is included, it may be useful in some embodiments to leave opening lips 180 or trim substantially uninstalled until after installation of junction box 200 and or LEM 300 to not impede insertion into luminaire housing 100, if opening lips 180 or trim do impede insertion, for example, by extending at least partially over luminaire housing opening 160. In such cases, however, opening lips 180 or trim could be installed after insertion of junction box 200 and/or LEM 300, if included opening lips 180 are included. Junction box 200 may then be transferred in second installation direction $I_2$ so that it substantially passes through junction box aperture 170. Junction box aperture 170 may matingly receive junction box 200, and junction box lips 280 may mate, attach, or connect to luminaire housing 100, such as, for example, at either or both of luminaire housing first side 130 and top wall 150, as shown in FIG. 8. Power supply cable 390*c* may be connected to power supply 290 and to LEM 300, as shown in FIG. 9, so that PCB 380 and/or LEDs 385 receive power and/or data. LEM 300 may then be transferred into internal cavity 190 of luminaire housing 100 in third installation direction $I_3$ until LEM clips 358 engage luminaire housing clips 158 to removably secure LEM 300 in position within luminaire housing 100, substantially resulting in the complete LED lighting fixture 10 retrofit installation shown in FIG. 3. Although use of LED lighting fixture 10 is primarily discussed herein as a way to retrofit an existing light source or other item that may be recessed, it is understood that the use of LED lighting fixture 10 is not so limited and should not be construed to be used only for that or any other purpose. LED lighting fixture 10 may be used for any of a variety of purposes, including but not limited to, using recessed lighting within tight space restraints or for any other reason.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

What is claimed is:

1. A retrofit LED lighting fixture, comprising:

a luminaire housing having an opening, said luminaire housing having a top wall opposite said opening;

said luminaire housing defining an internal cavity;

said luminaire housing having a first side member positioned between said opening and said top wall, said first side member defining at least a portion of an outer side wall of said luminaire housing, said first side member having a junction box aperture;

a junction box containing a power supply, said junction box matingly received and removably retained within said junction box aperture of said luminaire housing, such that the junction box extends through the junction box aperture and at least a portion of said junction box extends beyond an outer perimeter of said top wall;

said junction box having a face plate removably affixed to said junction box by at least one affixation mechanism;

a light engine module removably retained within said internal cavity of said luminaire housing, said light engine module having at least one LED;

a side wall;

a light exit aperture substantially covered by a lens;

a second top wall, a planar support member mounted to said second top wall;

said at least one LED mounted on said planar support member, said planar support member positioned adjacent to said second top wall;

said light engine module having at least one first clip extending into said luminaire housing; and at least one second clip attached to said luminaire housing, said at least one second clip frictionally engaging and separable from said at least one first clip such that a pulling force (P) will separate said at least one first clip and said at least one second clip.

2. The retrofit LED lighting fixture of claim 1 wherein said at least one second clip is removably attachable to said top wall of said luminaire housing.

3. The retrofit LED lighting fixture of claim 2 wherein said at least one second clip engages one or more first top wall apertures of said luminaire housing.

4. The retrofit LED lighting fixture of claim 1 wherein said luminaire housing is longitudinally extending from a first end to a second end creating a substantially rectangular internal cavity.

5. The retrofit LED lighting fixture of claim 1, said junction box having one or more knockouts.

6. The retrofit LED lighting fixture of claim 1, said face plate adjacent said internal cavity of said luminaire housing.

7. The retrofit LED lighting fixture of claim 6, said power supply interposed between said face plate and a junction box wiring cavity.

8. The retrofit LED lighting fixture of claim 1 further comprising a heat dissipating structure attached to an outer surface of said second top wall, said heat dissipating structure including one or more fins extending into said luminaire housing internal cavity.

* * * * *